US007699073B2

(12) United States Patent
Decker et al.

(10) Patent No.: US 7,699,073 B2
(45) Date of Patent: Apr. 20, 2010

(54) SOFT START DEVICE FOR COMPRESSED AIR SYSTEMS

(75) Inventors: Andreas Decker, Korntal (DE); Karl Messerschmidt, Esslingen (DE); Günter Gebauer, Esslingen (DE)

(73) Assignee: Festo AG & Co. KG, Esslingen (DE)

( * ) Notice: Subject to any disclaimer, the term of this patent is extended or adjusted under 35 U.S.C. 154(b) by 776 days.

(21) Appl. No.: 11/235,260

(22) Filed: Sep. 26, 2005

(65) Prior Publication Data

US 2006/0070673 A1 Apr. 6, 2006

(30) Foreign Application Priority Data

Oct. 6, 2004 (DE) ..... 20 2004 015 468 U

(51) Int. Cl.
*F15B 20/00* (2006.01)

(52) U.S. Cl. ..... 137/613; 137/599.08; 137/625.64; 137/628

(58) Field of Classification Search ..... 137/110, 137/599.01, 599.08, 601.18, 601.19, 613, 137/625.64, 628, 629
See application file for complete search history.

(56) References Cited

U.S. PATENT DOCUMENTS

| | | | | |
|---|---|---|---|---|
| 3,415,165 | A | 12/1968 | Grotewohl | |
| 4,694,791 | A * | 9/1987 | Tanaka | 123/179.31 |
| 5,038,813 | A * | 8/1991 | Rossow | 137/110 |
| 5,067,519 | A * | 11/1991 | Russell et al. | 137/596.14 |
| 5,295,511 | A * | 3/1994 | Schleinhege et al. | 137/625.64 |
| 5,337,788 | A * | 8/1994 | Nelson | 137/627.5 |
| 5,381,828 | A * | 1/1995 | Kimura et al. | 137/599.08 |
| 5,669,422 | A * | 9/1997 | Tarusawa | 137/625.64 |

FOREIGN PATENT DOCUMENTS

| | | |
|---|---|---|
| DE | 1450 486 | 12/1968 |
| DE | 35 29 802 A1 | 2/1987 |
| DE | 43 36 306 C1 | 4/1995 |
| DE | 696 10 429 T2 | 4/2001 |
| DE | 102 17 037 B4 | 5/2004 |
| EP | 0 758 063 B1 | 9/2000 |

OTHER PUBLICATIONS

Deppert et al., "Pneumatusche Steuerungen", Kamprath-Rheihe, Wurzberg DE (1994).
FESTO, "der Pneumatic-Katalog", FESTO AG & Co, Esslingen DE (1997).

* cited by examiner

*Primary Examiner*—Stephen Hepperle
*Assistant Examiner*—Craig Price
(74) *Attorney, Agent, or Firm*—Hoffman & Baron, LLP

(57) ABSTRACT

A soft start device for compressed air systems comprises a primary inlet at which compressed air at a primary pressure may be supplied, the primary inlet being connected with a secondary outlet able to be coupled with a load, by a valve circuit, at which compressed air is taken at the secondary pressure lower than or equal to the primary pressure, a principal valve placed between the primary and secondary outlet, said principal valve being able to be shunted by a bypass, a choke device being placed in the bypass, the principal valve and the choke device together with further valves of the valve circuit being connected together in a circuit and the valve circuit placed in a standard venting switching setting that the secondary outlet is vented.

13 Claims, 10 Drawing Sheets

SOFT START DEVICE FOR COMPRESSED AIR SYSTEMS

CROSS-REFERENCE TO RELATED APPLICATION

This application claims priority based on German Patent Application No. 20 2004 015 468.4 filed on Oct. 6, 2004, which is incorporated herein by reference.

FIELD OF THE INVENTION

The invention relates to a soft start device for compressed air systems, comprising:

a primary inlet by way of which compressed air may be supplied at a primary pressure, said primary inlet being able to be coupled with a secondary outlet, able to be coupled with at least one load, by way of a valve circuit, at which compressed air at a secondary pressure may be removed, the secondary pressure being less than or equal to the primary pressure, a principal valve of the normally closed type 2/2 being placed between the primary inlet and the secondary outlet, said valve being able to be shunted by a bypass, said bypass including a choke device, said principal valve and said choke device together with further valves of the valve circuit being so connected together that (with the principal valve initially turned off) during a starting operation with the principal valve initially closed compressed air is applied to the primary outlet at a gradually increasing secondary pressure less than the primary pressure, until as from a predetermined relationship between the secondary and primary pressures a switching operation of the principal valve into its open position takes place so that compressed air passes at the primary pressure to the secondary outlet, and the valve circuit is adapted to be set in such a standard venting switching setting that the secondary outlet is vented.

BACKGROUND OF THE INVENTION

Soft start devices are employed in compressed air systems to supply functional units of the type likely to be damaged by pressure surges, as for example servicing device or the like, with compressed air, the pressure gradually rising from a relatively low secondary pressure to the primary pressure or operational pressure. Accordingly pressure surges at a high, destructive primary pressure are prevented. Functional units liable to such pressure surge damage are for example filter units or double acting pneumatic cylinders. In the case of double acting pneumatic cylinders there may be the problem that the piston in the "pressure-less" state of the cylinder is in a middle position so that, if the full pressure surge were to act on the piston, same might be driven with an impact into the one of the end positions, something which might entail damage to the piston or at the terminal abutment in the cylinder. Dangerous movements might more particularly involve injury to persons. This is something to be prevented by a soft start so that the piston travels relatively slowly into its terminal position.

A soft start device of the type initially mentioned is for example described in the European patent publication 0 758 063 B1, in the case of which a starting valve in the form of a valve with a seat is disclosed, said valve being vented by way of an instant venting means. The starting valve possesses a housing in which a single flow path is defined extending from the inlet to the outlet, the flow path having a valve with a seat arranged on it acting as a choke.

In compressed air systems certain safety aspects must be taken into account. They are for example categorized in the German Industrial Standard DIN EN ISO 13849-1. In order to comply with the category 3 in the Standard EN 954-1 there is requirement for the compressed air device to have a so-called "single error safety" for safety-relevant functions. This means that despite a single error in the system venting is still possible.

SUMMARY OF THE INVENTION

One object of the invention is to provide a soft start device of the type initially mentioned offering "single error safety" during venting and which accordingly fulfills the category 3 of the above mentioned Industrial Standard.

In order to achieve these and/or other objects appearing from the present specification, claims and drawings, the features of the independent claim 1 are adopted. Further developments of the invention are recited in the dependent claims.

The soft start device in accordance with the invention is characterized in that the valves of the valve circuit are so placed in circuit with each other that in addition to the standard venting switching setting a plurality of further venting switching settings is possible, each of the further venting switching settings resulting, when in the actuating operation normally causing the standard venting switching setting, any one of the valves present exhibits a trouble condition.

The secondary outlet may therefore be operated despite faulty functioning of one of the valves, since the soft start device all in all exhibits "single error safety. Accordingly it complies with the requirements of the Standard EN 954-1, category 3.

In the case of a further development of the invention the soft start device has the following design of the valve circuitry:

the inlet of a second directional valve of the normally closed (nc) type 3/2 is connected with the primary inlet and the outlet of the second directional valve is connected in a parallel circuit with the inlet of the principal valve designed as the fifth directional valve of the type 2/2/-nc, with the inlet of a third directional valve of the type 3/2-nc, with the inlet of the choke device and with the outlet of a check valve adapted to close in the secondary outlet direction, the second directional valve being adapted to be vented by way of a venting exit and is coupled on the control side with the primary inlet, the inlet of a first directional valve of the type 3/2-nc, serving for control of the second directional valve, is connected with the primary inlet and the outlet is connected with the control side of the second directional valve, the first directional valve being able to be vented by way of a venting exit and to be actively switched by means of switching means arranged on the control side, the outlet of the fifth directional valve is connected with the inlet of a fourth directional valve of the type 3/2-nc and in parallel with the outlet of the choke device, the fifth directional valve being coupled with the outlet of the fourth directional valve, the outlet of the third directional valve serving for control of the fourth directional valve is coupled with the control side of the fourth directional valve, the third directional valve being able to be vented by way of a venting exit and being able to be actively switched by way of switching means arranged on the control side, the outlet of the fourth directional valve is connected in parallel for coupling with the control side of the fifth directional valve, with the secondary outlet and with the inlet of the check valve, the fourth directional valve being able to be vented by way of a venting exit.

Preferably the first and the second directional valves together constitute a switching-on stage placed upstream from the fifth directional valve and, respectively, the principal valve and the third, fourth and fifth directional valves together with the choke device and the check valve constitute a soft start stage rendering possible the soft start. The switching-on stage may be arranged in a switching-on valve unit and the soft start stage in a separate soft start unit able to be separated from the switching-on valve unit. The soft start device in accordance with the invention may consequently consist of two separate assembly units, of which the one assembly unit provides a "switching-on function" and the other assembly unit provides a "soft start function".

In the case of an alternative design the valve circuit has the following form:

the inlet of the principal valve designed as the fifth directional valve of the type 2/2-nc is connected with the primary input and the outlet is connected with the inlet of a fourth directional valve of the type 3/2-nc and in parallelism to this with the outlet of the choke device, the fifth directional valve being coupled on the control side with the outlet of the choke device and additionally with an outlet of a sixth directional valve of the type 4/2-nc, the inlet of the first directional valve of the type 3/2-nc is connected with the primary inlet and the outlet is connected with the inlet of a third directional valve of the type 3/2-nc and in parallelism thereto with the control side of the sixth directional valve, the first directional valve being able to be vented by way of a venting exit and actively switched by switching means arranged on the control side, the outlet of the third directional valve is coupled with the control side of a fourth directional valve of the type 3/2-nc, the third directional valve being able to be vented by way of a venting exit and is able to be actively switched by way of switching means arranged on the control side, the outlet of the fourth directional valve is connected with the secondary outlet and parallel thereto is connected with an inlet of the sixth directional valve, the fourth directional valve being able to be vented by way of a venting exit, and the sixth directional valve is able to be switched between a normal setting and a functional setting and in the normal setting a first inlet is connected with the secondary outlet and parallel thereto with the outlet of the fourth directional valve, while the first outlet belonging thereto is open to the atmosphere and a second inlet is coupled with the control side of the fifth directional valve, while a second outlet belonging thereto is open to the atmosphere and in the functional setting the inlet is connected with the outlet of the fourth directional valve and parallel thereto is connected with the secondary outlet and the outlet belonging thereto is coupled with the control side of the fifth directional valve.

Preferably the directional valves, which are not able to be actively switched, are held in their normally closed (nc) setting by setting springs and additionally by the action of compressed air in order to achieve independence from pilot pressure. As an alternative it would naturally also be possible to hold the respective directional valves without additional pressure action in their normally closed setting and for example to use a setting spring with a suitable spring force.

It is possible for the choke device to have an adjustable choke valve and additionally a set choke in the form of a choke bypass shunting the adjustable choke. This prevents the flow path being completely blocked during complete closure of the choke valve.

Further advantageous developments and convenient forms of the invention will be understood from the following detailed descriptive disclosure of embodiments thereof in conjunction with the accompanying drawings.

DETAILED DESCRIPTION OF THE PREFERRED EMBODIMENTS

FIG. 1 through 10 show a first embodiment of the soft start device 11 of the invention.

The valve circuit in accordance with the first embodiment possesses a primary inlet P1, to which compressed air is supplied at a primary pressure. The primary inlet is connected with a secondary outlet P2 able to be coupled with at least one load, at which compressed air is removed at a secondary pressure, the secondary pressure being equal to or lower than the primary pressure. The entire soft start device 11 may for example be placed upstream from a servicing unit so that any pressure surges otherwise acting on pressure surge-sensitive components of the servicing unit are attenuated. A further field of application for the soft start device involves placing it upstream from a double acting pneumatic cylinder so that pressure surges otherwise affecting the piston of the pneumatic cylinder are attenuated as long as same is not in a terminal position but in a mid stroke position.

The primary inlet P1 and the secondary outlet P2 are connected together by way of a principal flow path 12 on which several directional valves are placed in a manner to be described in the following.

Figure 1:
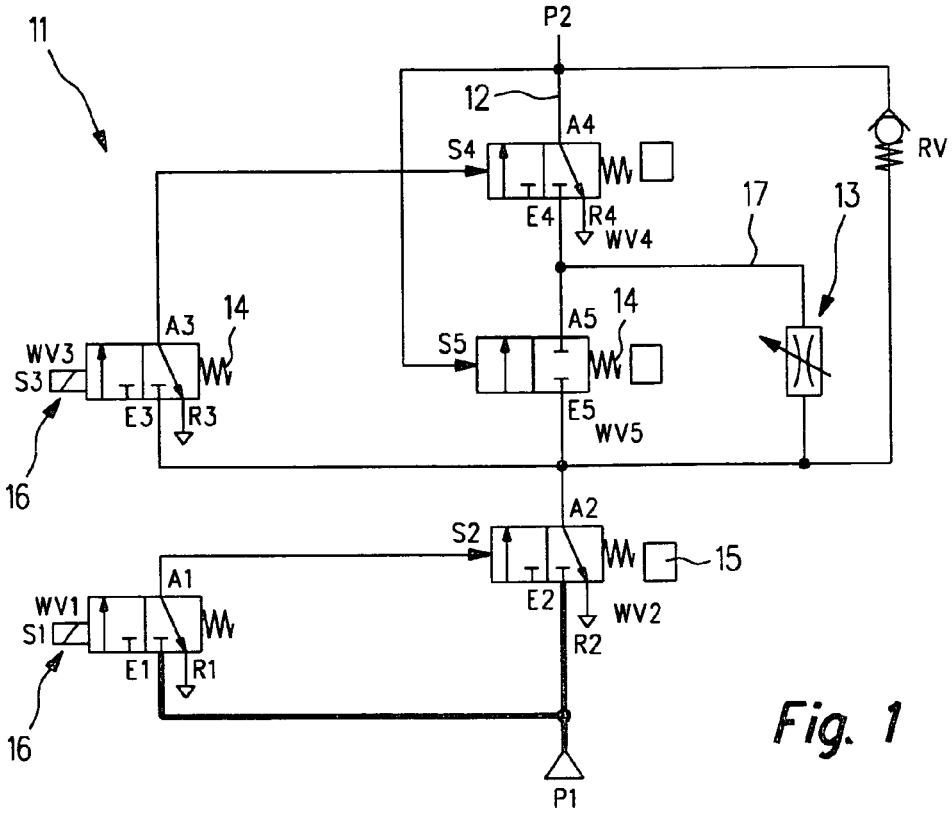
FIG. 1 shows the valve circuit together with branches subjected to compressed air (thick lines) of a first embodiment of the soft start device in accordance with the invention in the resting state prior to the starting operation.

As represented for example in FIG. 1 the valve circuit of the first embodiment of the soft start device 11 in accordance with the invention has the following design:

A second directional valve WV2 of the type 3/2-nc is provided, whose inlet E2 is connected with the primary inlet P1 and whose outlet A2 is connected (a) in a parallel circuit with the inlet E5 of the principal valve, constituting the fifth directional valve WV5 of the type 2/2-nc, (b) with the inlet E3 of a third directional valve WV3 of the type 3/2-nc, (c) with the inlet of the choke device 13 and (d) with the outlet of a check valve RV adapted to close in the direction toward the secondary outlet P2, the second directional valve WV2 being able to be vented via a venting exit R2 and on the control side is connected with the primary inlet P1. The second directional valve WV2 is held in its normally closed or nc setting by a setting spring 14. In order to detect the current switched state of the second directional valve WV2 same is provided with a sensor 15 of a sensor means. The second directional valve WV2 is controlled by way of a first directional valve WV1 of the type 3/2-nc.

The inlet E1 of the first directional valve WV1 is connected with the primary inlet P1 and the outlet A1 is connected with the control side S2 of the second directional valve WV2, the first directional valve WV1 being able to be to be vented by way of a venting exit R1 and is able to be actively switched by way of switching means 16 arranged on the control side. As switching means manually or electrically operated setting members come into question.

As already mentioned the outlet A2 of the second directional valve WV2 is connected with the inlet E5 of the fifth directional valve WV5. The outlet A5 of the fifth directional valve WV5 is connected with the outlet E4 of a fourth directional valve WV4 of the type 3/2-nc and in parallel thereto with the outlet of the choke device 13, the fifth directional valve WV5 being coupled on the control side with the outlet A4 of the fourth directional valve WV4. The fifth directional valve WV5 is also held in its normally closed (nc) position by way of a setting spring 14. Furthermore a sensor 15 is provided for detecting the current switched state of the fifth directional valve WV5. In order to circumvent or shunt the fifth directional valve WV5 located in the principal current path 12, a bypass 17 is provided with the choke device 13 on it.

A third directional valve WV3 is provided serving for control of the fourth directional valve WV4. The outlet A3 of the third directional valve WV4 is coupled with the control side S4 of the fourth directional valve WV4, the third directional valve WV3 being able to be vented by way of a venting exit R3 and being able to be actively switched by way of switching 16 means arranged on the control side.

Finally there is also the fourth directional valve WV4 which is arranged on the principal current path 12 too and is arranged downstream from the fifth directional valve WV5 or, respectively, principal valve. The outlet A4 of the fourth directional valve WV4 is connected in parallel to the coupling with the control side S5 of the fifth directional valve WV5, with the secondary outlet P2 and with the outlet of the check valve RV, the fourth directional valve WV4 being able to be vented by way of a venting exit R4.

FIG. 1 shows a switching setting in which all directional valves WV1 through WV5 are in their normally closed or nc setting so that this state may also be referred to as the "quiescent" or resting state prior to the soft start operation. In this case the compressed air flows by way of the primary inlet P1 at the primary pressure both to the inlet E1 of the first directional valve WV1 and also to the inlet E2 of the second directional valve WV2, where it halts because the passage is turned off.

Figure 2:
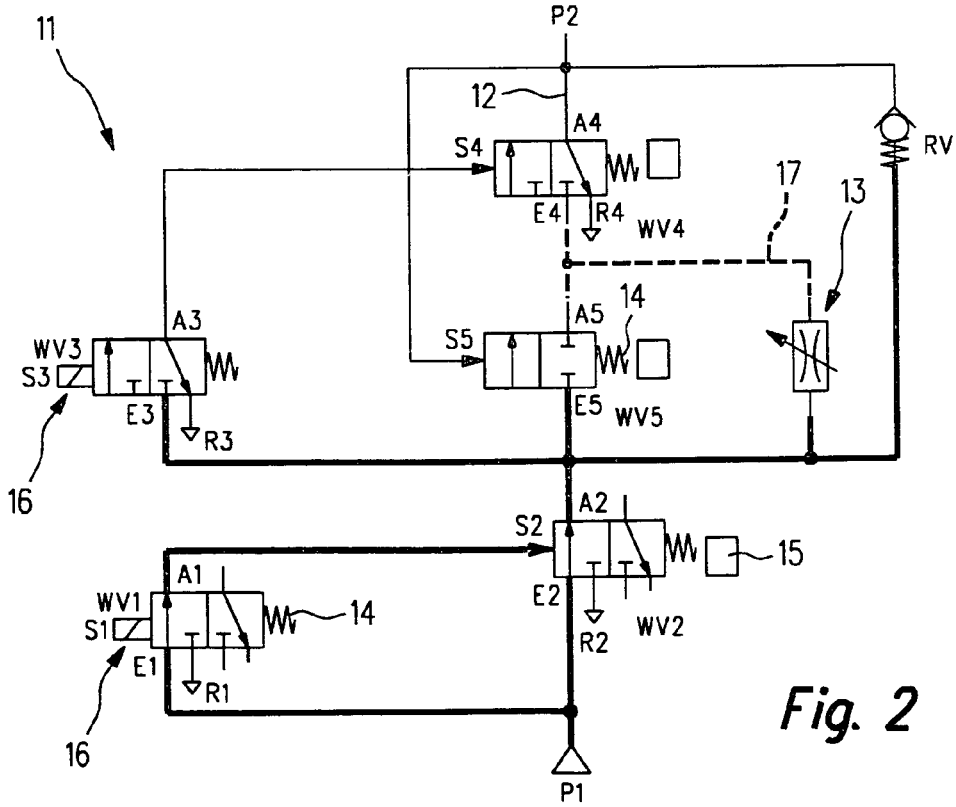
FIG. 2 shows the valve circuit of FIG. 1 with the first directional valve switched.

FIG. 2 shows a hypothetical switching state in which initially just the first directional valve WV1 is actively switched into its open setting, whereas the third directional valve WV3 just remains in its normally closed setting. Now compressed air at the primary pressure passes by way of the first directional valve WV1 to the control side S2 of the second directional valve WV2 switching it into its open position. Via the open second directional valve WV2 compressed air flows at the primary pressure along the principal flow path to the inlet E5 of the fifth directional valve WV5, where it halts, because the fifth directional valve is just remaining in its normally closed setting. Parallel to this compressed air passes at the primary pressure to the inlet E3 of the third directional valve WV3 where its also halts, because the third directional valve WV3 is still in its normally closed setting. In addition compressed air flows into the bypass 17 and thence to the choke device 13, which includes an adjustable choke valve adapted to choke the compressed air back to a secondary pressure lower than the primary pressure. The compressed air at the secondary pressure now flows to the outlet A5 of the fifth directional valve, and parallel thereto to the inlet E4 of the fourth directional valve without however getting any farther since the fourth and the fifth directional valves WV4 and WV5 are still in their normally closed settings. Furthermore compressed air stemming from the outlet A2 of the second directional valve passes to the check valve RV too without being able to flow through it because the check valve RV is turned off in this direction, that is to say toward the secondary outlet P2.

Figure 3:
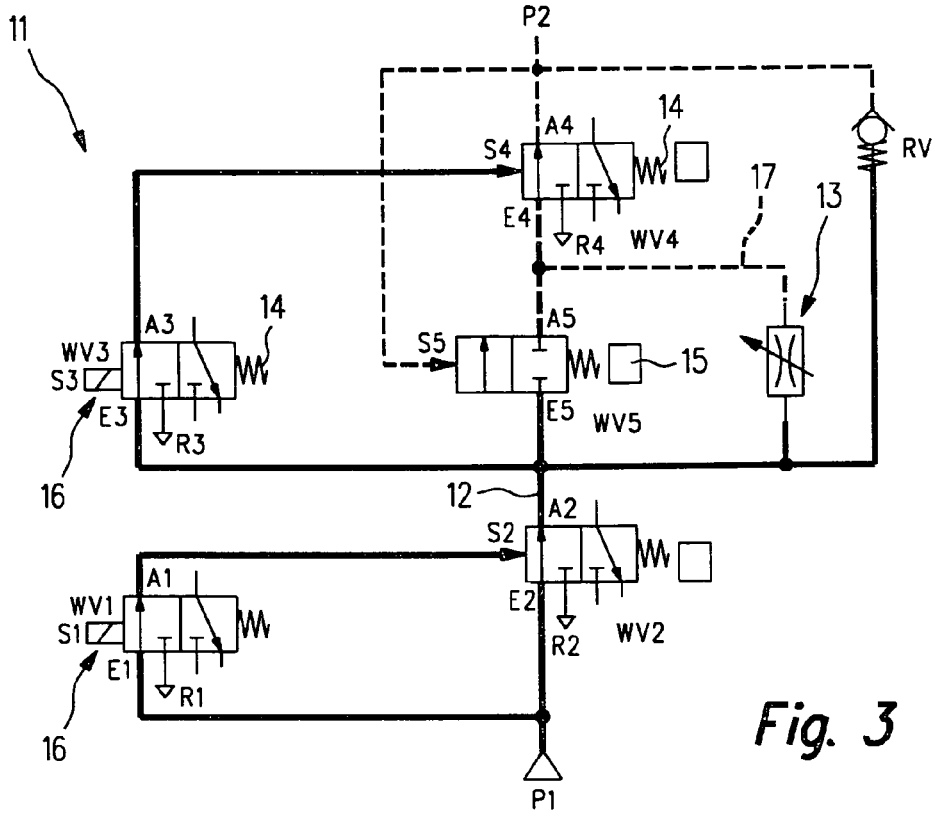
FIG. 3 shows the valve circuit of FIG. 1 with the first and third directional valves switched, the starting operation having been commenced.

FIG. 3 now shows the switching setting for initiating the soft start operation. In this case the first and the third directional valves WV1 and WV3 are simultaneously shifted into their open setting. Now compressed air from the outlet A2 of the second directional valve flows at the primary pressure to the third directional valve, through same and arrives at the control side S4 of the fourth directional valve WV4. Accordingly the fourth directional valve is switched into its open setting so that by means of the choke valve compressed air choked to be at the secondary pressure can flow by way of the outlet A4 of the fourth directional valve to the control side S5 of the fifth directional valve WV5. Simultaneously compressed air at the secondary pressure flows to the secondary outlet P2 and thence to the loads, which are accordingly not subjected to the full primary pressure surge but initially just to the lower secondary pressure. The secondary pressure gradually increases until, as from a certain relationship between the secondary and primary pressures the fifth directional valve WV5 is shifted into the open setting. The ratio between the secondary and the primary pressures may for example be between >0 to 1 and more particularly between 0.4 and 0.6. More particularly switching into the open setting occurs if the secondary pressure $p_2$ is equal to approximately 0.5 times the primary pressure $p_1$.

Figure 4:
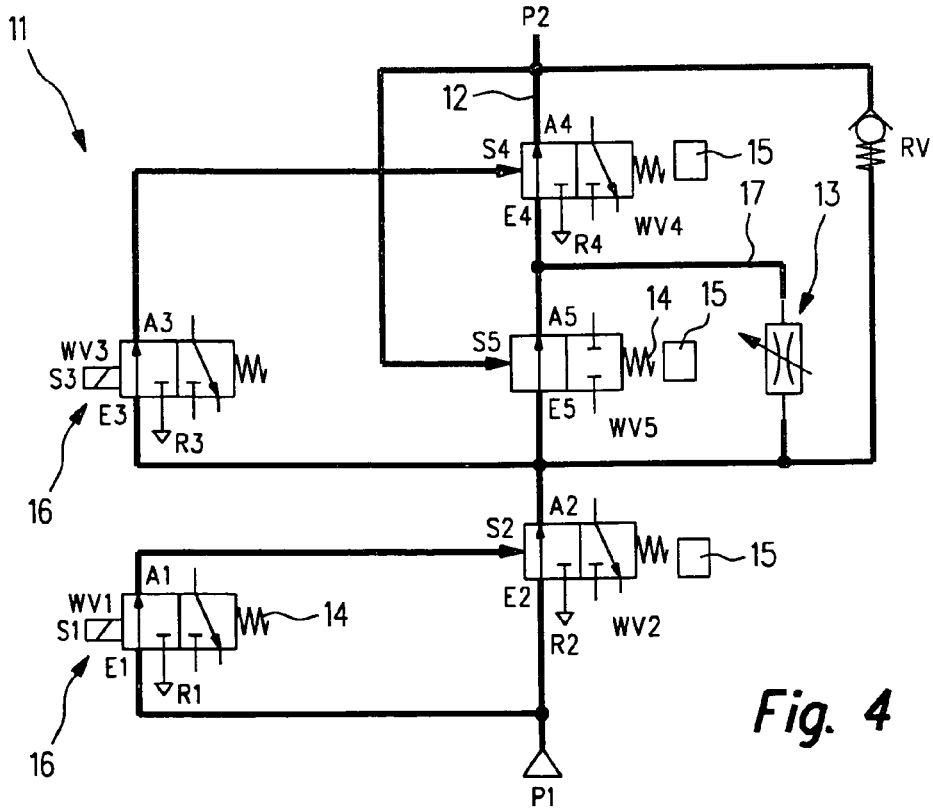
FIG. 4 shows the valve circuit of FIG. 1 after the starting operation.

FIG. 4 shows the switching setting following a soft start operation, all directional valves WV1 through WV5 being in the open setting. Accordingly compressed air at the primary pressure flows from the primary inlet P1 directly by way of the principal flow path 12 to the secondary outlet P2 and thence to the loads.

For venting the secondary outlet P2 the soft start device 11 is switched into a standard venting switching setting, whose circuit diagram corresponds to the circuit diagram in FIG. 1. The first and the third directional valves are accordingly switched back into their normally closed setting. This means that compressed air can escape from the control side S4 of the fourth directional valve by way of the venting exit R3 so that the fourth directional valve WV4 is switched back into its normally closed setting. Simultaneously compressed air escapes from the control side S2 of the second directional valve by way of the venting exit R1 of the first directional valve WV1 so that the second directional valve WV2 is switched back into its normally closed setting too. In the normally closed setting of the fourth directional valve compressed air just present at the secondary outlet P2 can escape by way of the venting exit R4. Simultaneously compressed air also escapes from the control side S5 of the fifth directional valve WV5 so that this valve is switched into the normally closed setting as well. The remaining branches are vented by way of the second directional valve WV2 and its venting exit R2.

Figure 5:
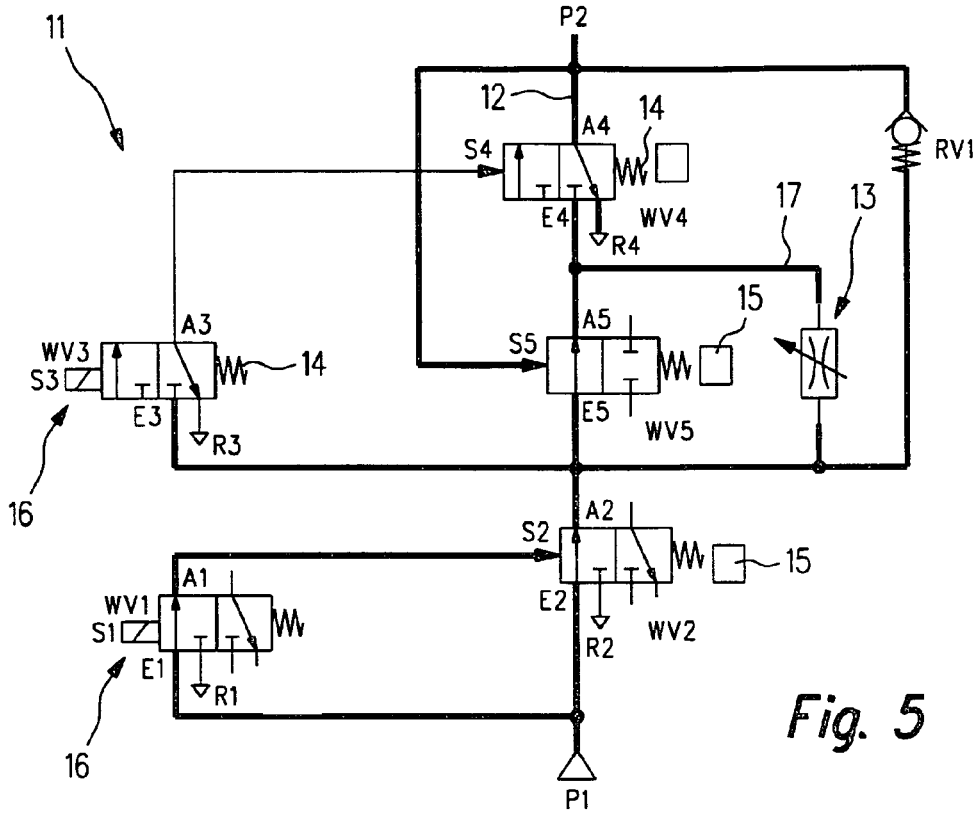
FIG. 5 shows the valve circuit in accordance with FIG. 1 during the venting operation with a faulty function of the first directional valve.

FIG. 5 shows a venting switching setting involving faulty operation of the first directional valve WV1, meaning that it is not switched back into its normally closed setting and dwells in its open setting. Accordingly the control side S2 of the second directional valve continues to be subjected to compressed air so that the second directional valve also remains in its open setting and venting by way of the venting exit R2 is blocked. The secondary outlet P2 can however, despite the faulty function of the first directional valve WV1, still be vented, since the third directional valve WV3 has been properly switched into its normally closed setting and accordingly the fourth directional valve WV4 is switched back into normally closed setting as well. As a result compressed air coming from the secondary outlet P2 may escape by way of the venting exit R4 of the fourth directional valve WV4.

Figure 6:
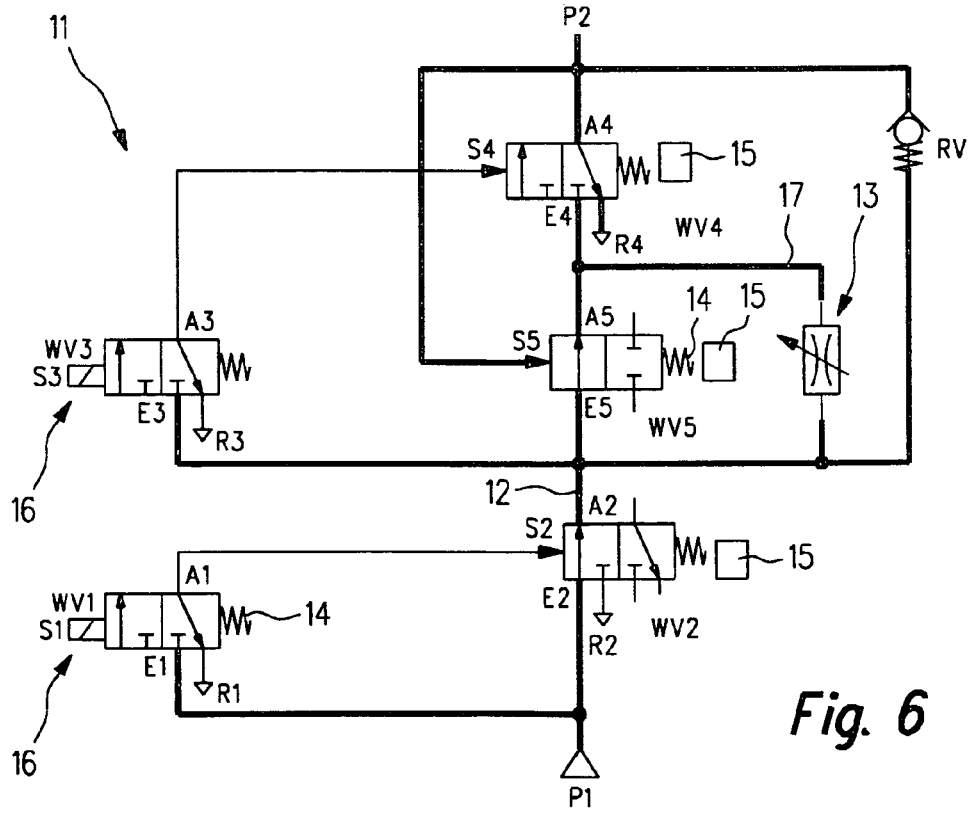
FIG. 6 shows the valve circuit of FIG. 1 during the venting operation and with a faulty function of the second directional valve.

FIG. 6 shows a venting switching setting with a faulty function of the second directional valve WV2 so that it is not switched back into normally closed setting. The passage E2-A2 is therefore still open so that compressed air at the primary pressure may pass from the primary inlet P1, whereas on the other hand the venting exit R2 is turned off. Yet compressed air stemming from the secondary outlet P2 may still escape, by way of the fourth directional valve WV4 which has properly switched back into its normally closed setting, by way of venting exit R4, because the third directional valve WV3 has correctly switched.

Figure 7:
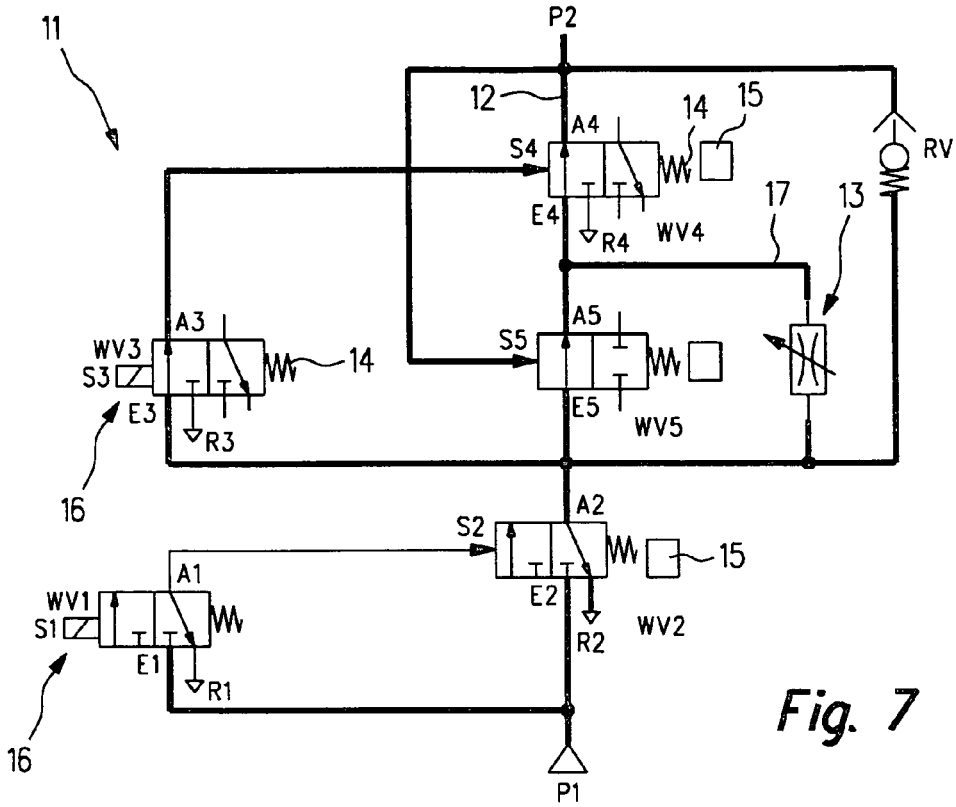
FIG. 7 shows the valve circuit of FIG. 1 during the venting operation and with a faulty function of the third directional valve.

FIG. 7 represents a venting switching setting involving faulty function of the third directional valve, that is to say it has not returned to its normally closed setting. Accordingly the control side S4 of the fourth directional valve continues to be subjected to compressed air so that it cannot return to its normally closed setting and in fact dwells in its open setting. This means that the venting exit R4 is turned off as regards the compressed air coming from the secondary outlet P2. It can however be vented, since such compressed air from the secondary outlet P2 passes oppositely to the principal flow direction, i.e. along the path A4-E4 and A5-E5, to the second directional valve WV2, which has been switched back into its normally closed setting by the correctly switched first directional valve WV1. Accordingly the compressed air may escape by way of the venting exit R2.

Figure 8:
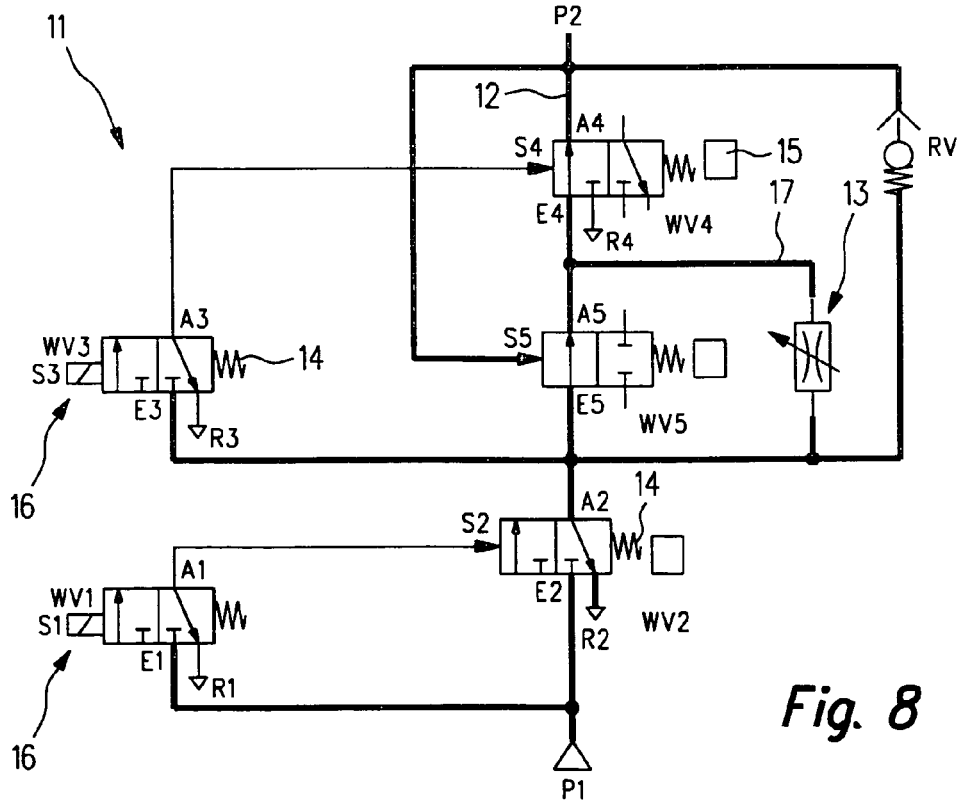
FIG. 8 shows the valve circuit of FIG. 1 during the venting operation and with a faulty function of the fourth directional valve.

FIG. 8 shows a venting switching setting in which the fourth directional valve WV4 is not correctly functioning, i.e. is not switched back into its normally closed setting. Accordingly the venting path for the venting exit R4 is turned off. Yet compressed air stemming from the secondary outlet P2 still passes in an identical manner like in the venting switching setting illustrated in FIG. 7 to the second directional valve and may thence escape by way of the venting exit R2.

Figure 9:
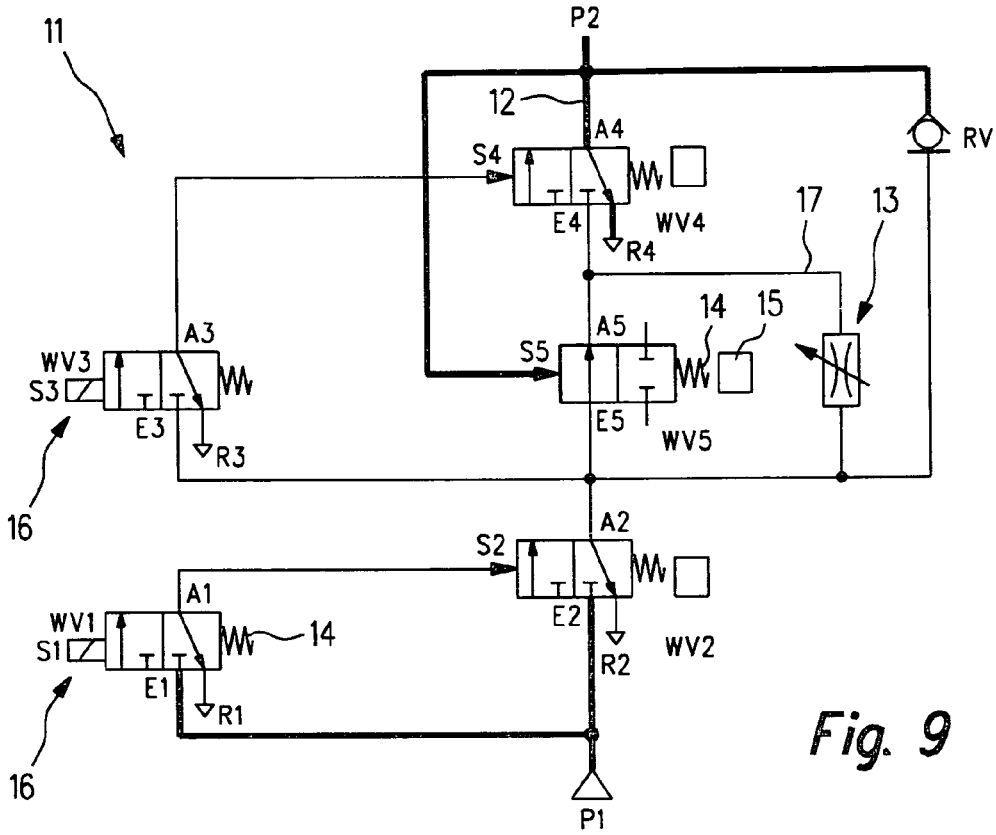
FIG. 9 shows the valve circuit of FIG. 1 during the venting operation and with a faulty function of the check valve.

FIG. 9 shows a venting switching setting involving faulty functioning of the check valve, i.e. it turns off in its intended open setting from the secondary outlet P2 to the primary inlet P1. The venting of the compressed air stemming from the secondary outlet P2 takes place in this case by way of fourth directional valve WV4, which owing to switching back of the third directional valve has switched back properly into its normally closed setting so that the compressed air may escape by way of the venting exit R4.

Figure 10:
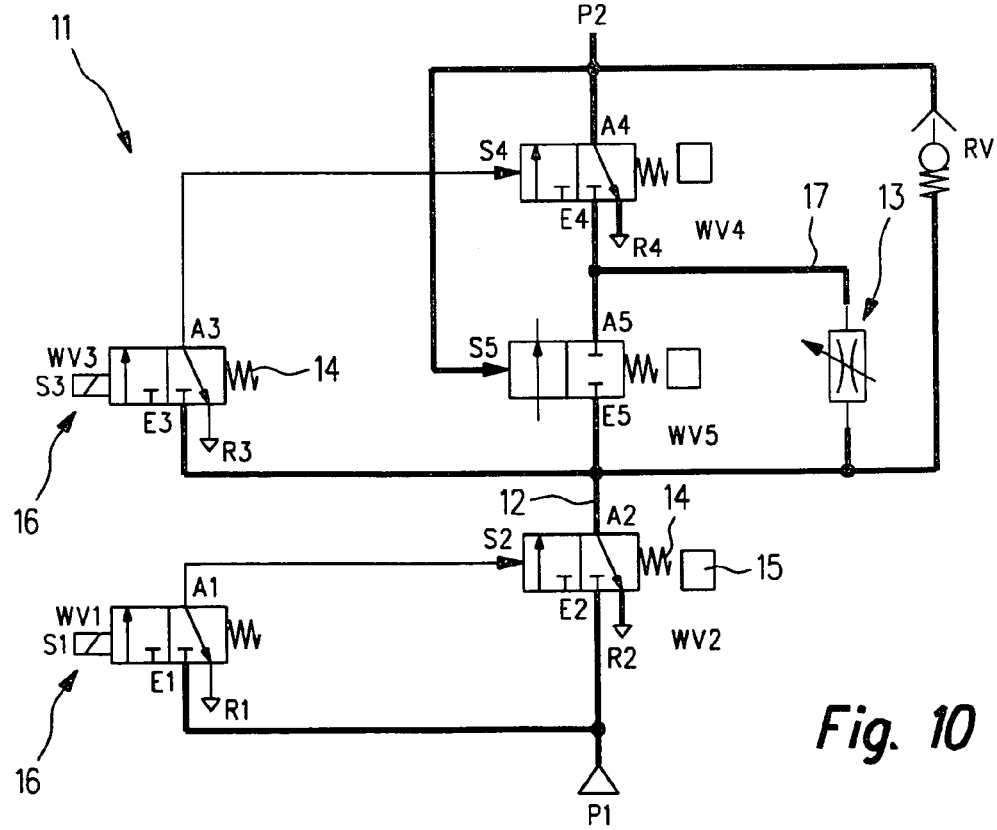
FIG. 10 shows the valve circuit of FIG. 1 during the venting operation, such venting taking place during the starting operation.

FIG. 10 shows a venting switching setting in which during a soft start operation, i.e. in the starting phase, venting takes place. The first and the third directional valves WV1 and WV3 have switched back into their normally closed setting so that the associated second and fourth directional valves WV1 and WV4 have returned to their normally closed setting too. Compressed air stemming from the secondary outlet P2 can now escape by way of the venting exits R4 of the fourth directional valve WV4. Additionally the remaining branches are responsible for venting by way of the second directional valve WV2 and its venting exit R2.

In FIGS. 11 through 20 a second embodiment of the soft start device 11 in accordance with the invention is represented.

The second embodiment is characterized in that the components of the valve circuit are all able to be accommodated jointly in a valve unit. In this case as well a primary inlet P1 is provided at which compressed air is supplied at the primary pressure. The primary inlet P1 is connected by way of a principal flow path 12 with a secondary outlet P2 at which in turn compressed air at a secondary pressure leaves and flows to the loads.

As for example depicted in FIG. 11, the valve circuit according to the second embodiment of the soft start device 11 in accordance with the invention is designed as follows:

A fifth directional valve WV5 of the normally closed type 2/2 is provided, whose inlet E5 is connected with the primary inlet P1 and whose outlet A5 is connected with the inlet E4 of a fourth directional valve WV4 of the normally closed type 3/2 and in parallelism with this with the outlet of the choke device 13, the fifth directional valve WV5 being connected on the control side with the outlet of the choke device 13 and additionally with an outlet A6 of a sixth directional valve WV6 of the normally closed type 4/2, if the sixth directional valve WV6 is in its functional setting as described below. The fifth directional valve WV5 is held in its normally closed setting by a setting spring 14 and additionally by means of the action of compressed air via a coupling with the primary inlet P1. Moreover the fifth directional valve WV5 is provided with a sensor 15 to detect its current switching state.

Connected in parallel with the fifth directional valve WV5 there is a first directional valve WV1, whose inlet E1 is connected with the primary P1 and whose outlet A1 is connected with the inlet E3 of a third directional valve WV3 of the normally closed type 3/2 and parallel to this is connected with the control side S6 of the sixth directional valve WV6, the first directional valve WV1 being able to be vented by way of a venting exit R1 and actively switched by way of switching means 16 arranged on the control side. Furthermore the first directional valve is held in its normally closed setting by means of a setting spring 14.

In series with the first directional valve WV1 a third directional valve WV3 is arranged whose outlet A3 is coupled with the control side S4 of a fourth directional valve WV4 of the normally closed type 3/2, the third directional valve WV3 being able to be vented by way of a venting exit R3 and able to be actively switched by way of switching means 16 arranged on the control side.

The fourth directional valve WV4 driven by the third directional valve WV3 is connected by way of its outlet A4 with the secondary outlet P2 and in parallelism to this with an inlet E6 of the sixth directional valve WV6, the fourth directional valve WV4 being able to be vented by way of a venting exit R4. The fourth directional valve WV4 is held in its normally closed setting by a setting spring 14 and additionally by means of compressed air (through the coupling with the outlet of the choke device 13 and parallel to this by coupling with the outlet A5 of the fifth directional valve WV5). In addition there is also a sensor 15 for detecting the current condition of switching of the fourth directional valve WV4.

The sixth directional valve WV6 is finally able to be switched between a normal setting and a functional setting, a first inlet E6 being connected in the normal setting with the secondary outlet P2 and in parallelism to this with the outlet A4 of the fourth directional valve WV4, whereas the first venting exit R6 belonging to this is open to the atmosphere. In the normal setting of the sixth directional valve WV6 furthermore a second inlet E6* is connected with the control side S5 of the fifth directional valve WV5, while a second venting exit R6* belonging to it is open to the atmosphere. In the functional setting of the sixth directional valve WV6 on the other hand its inlet E6 is connected with the outlet A4 of the fourth directional valve and in parallelism to this with the second outlet P2, while the associated outlet A6 is coupled with the control side S5 of the fifth directional valve WV5.

Figure 11:
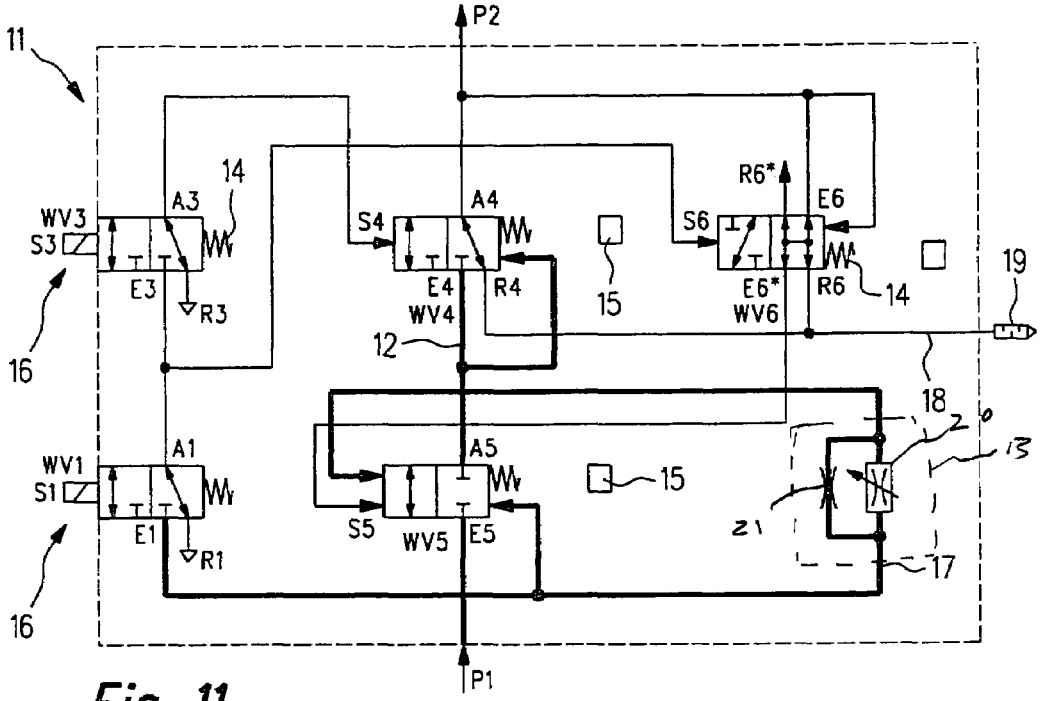
FIG. 11 shows the valve circuit together with branches subjected to compressed air (thick lines) of a second embodiment of the soft start device in accordance with the invention in the resting state prior to the starting operation.

In FIG. 11 a switching state is represented in which all 2/3 and, respectively, 2/2 directional valves are in the normally closed setting, and the sixth directional valve WV6 of the normally closed type 4/2 is in its normal setting. This setting could also be termed the resting setting preceding the soft start operation. In this case compressed air from the primary inlet P1 and at the primary pressure is present at the inlet E1 of the closed first directional valve WV1 and in parallelism to this at the inlet E5 of the closed fifth directional valve WV5. Parallel to this compressed air flows to aid the setting spring 14 on the opposite control side of the fifth directional valve WV5. Lastly compressed air flows into the bypass 17 and thence to the choke device 13 and thence to the inlet E4 of the closed fourth directional valve, to the outlet A5 of the closed fifth directional valve WV5 and to the control side S5 of the fifth directional valve WV5. As the choke device in this case, an adjustable choke valve 20 is provided and additionally a set choke 21 in the form of a choke-bypass shunting the adjustable choke 20. Accordingly it is possible to prevent the flow path being completely shut when the choke valve is closed. In fact it is always possible for a quantity of compressed air to pass by way of the choke-bypass, which has a relatively small cross section, to the associated connections of the fourth and fifth directional valves WV4 and WV5. Finally the compressed air at the primary pressure is also present at the opposite control side of the fourth directional valve WV4 and accordingly reinforces the setting spring 14.

Figure 12:
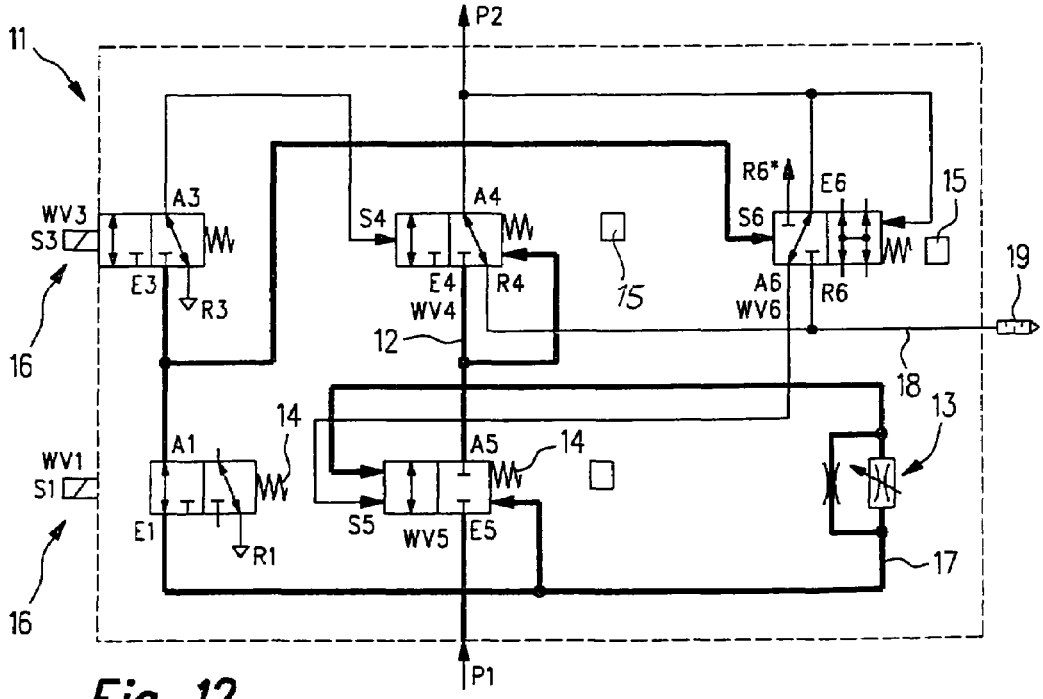
FIG. 12 shows the valve circuit of FIG. 11 with the first directional valve switched.

FIG. 12 shows a hypothetical switching setting in which initially only the first directional valve WV1 is switched into its open position so that compressed air arrives at the inlet of the third directional valve WV3, which still dwells in its normally closed setting, and is present here and compressed air at the primary pressure flows to the control side S6 of the sixth directional valve WV6 and switches it into its functional setting. The fourth and the fifth directional valves WV4 and WV5 are however still closed, i.e. in their normally closed settings.

Figure 13:
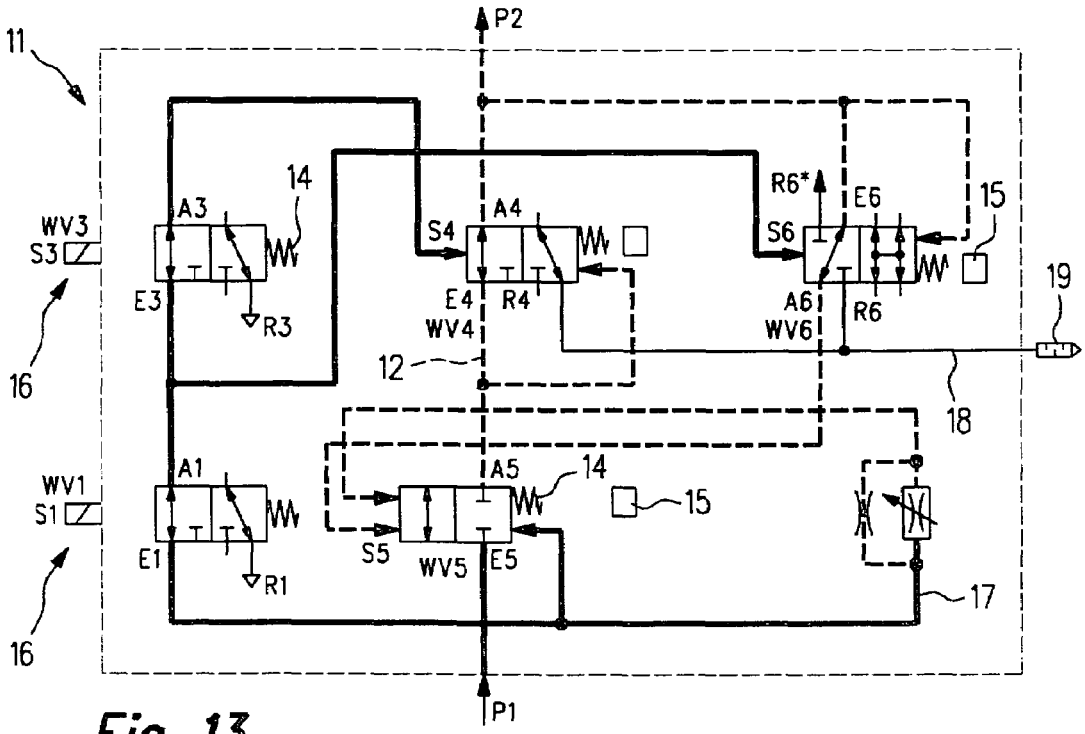
FIG. 13 shows the valve circuit of FIG. 11 with the first and third directional valves switched, the soft start operation having been commenced.

FIG. 13 shows a switching setting on starting the soft start operation. In this case the first directional valve WV1 and the third directional valve WV3 have properly switched into their open setting, compressed air flowing by way of the third directional valve WV3 to the control side S4 of the fourth directional valve WV4 and switching it into its open setting. Although in the turned off state of the fourth directional valve WV4 there is back pressure of the compressed air at the primary pressure upstream from the inlet E4 of the valve WV4, such quantity of compressed air initially trapped between the outlet of the choke device 13 and the inlet E4 of the fourth directional valve is let off on opening the fourth directional valve WV4 and flows to the secondary outlet P2. Compressed air at the primary pressure can however not immediately flow in to take its place, since the choke device 13 is placed in between, and it chokes the compressed air flowing in at the primary pressure back to the secondary pressure. Therefore compressed air at the secondary pressure arrives at the fourth WV4 and thence at the secondary outlet P2. Simultaneously the compressed air at the secondary pressure passes to the inlet E6 of the sixth directional valve WV6 and thence via the outlet A6 to the control side S5 of the fifth directional valve WV5. Simultaneously there is a direct connection from the outlet of the choke device 13 to the control side S5 of the fifth directional valve WV5 so that the fifth directional valve WV5 is doubly acted upon by compressed air at the secondary pressure at the control side. The pressure at the secondary outlet P2 now gradually rises until as from a predetermined relationship between the secondary and primary pressures switching of the fifth directional valve WV5 into its open setting is effected. The relationship between the secondary and the primary pressures is preferably identical to that disclosed in the first embodiment. It is more particularly preferred for the relation between the secondary and primary pressures to be approximately 0.5.

Figure 14:
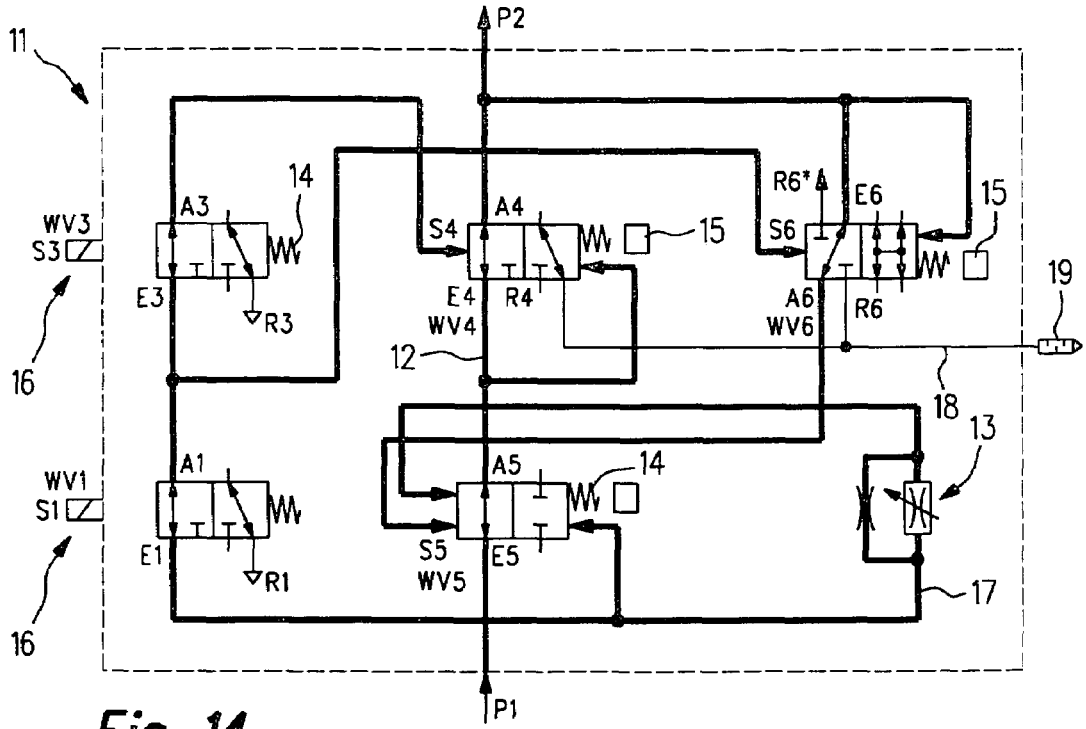
FIG. 14 shows the valve circuit of FIG. 11 after the soft starting operation.

FIG. 14 now shows a switching setting following a soft start operation. Owing to the pressure acting on the control side S5 of the fifth directional valve WV5 it is opened so that compressed air flows directly from the primary inlet P1 by way of the principal flow path 12, and through the fourth directional valve WV4, to the secondary outlet P2 and thence to the loads.

Figure 15:
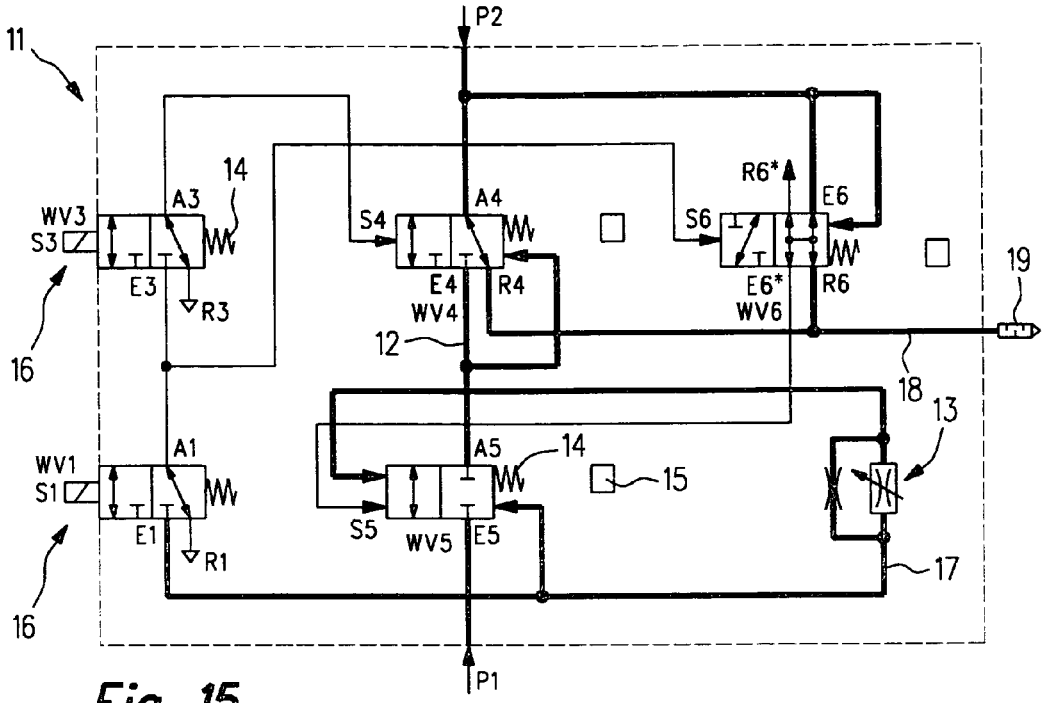
FIG. 15 shows the valve circuit in accordance with FIG. 11 during the venting operation in the standard venting switching setting.

FIG. 15 shows a standard venting switching setting for venting the secondary outlet P2. In this case the first and the third directional valves WV1 and WV3 have switched back properly to their normally closed setting so that the compressed air at the control side S4 of the fourth directional valve WV4 can escape by way of the venting exit R3, whereas the compressed air present at the control side S6 of the sixth directional valve WV6 escapes via the venting exit R1.

Accordingly the fourth directional valve WV4 is switched into its normally closed setting as an intermediate setting, whereas the sixth directional valve WV6 is switched back into its normal setting. Compressed air stemming from the secondary outlet P2 can now escape via the venting exit R4 of the fourth directional valve WV4 and additionally via the venting exit R6 of the sixth directional valve WV6. In a preferred manner the venting exits R4 and R6 are collected together in a common central venting exit 18 open to the atmosphere. Furthermore the central venting exit 18 can have a muffler 19 for silencing the emerging compressed air.

If the soft start operation is interrupted and if venting is to take place, the standard venting switching setting is produced, that is to say compressed air from the secondary outlet P2 escapes by way of the venting exits R4 and R6 of the fourth and, respectively, sixth directional valves WV4 and WV6.

Figure 16:
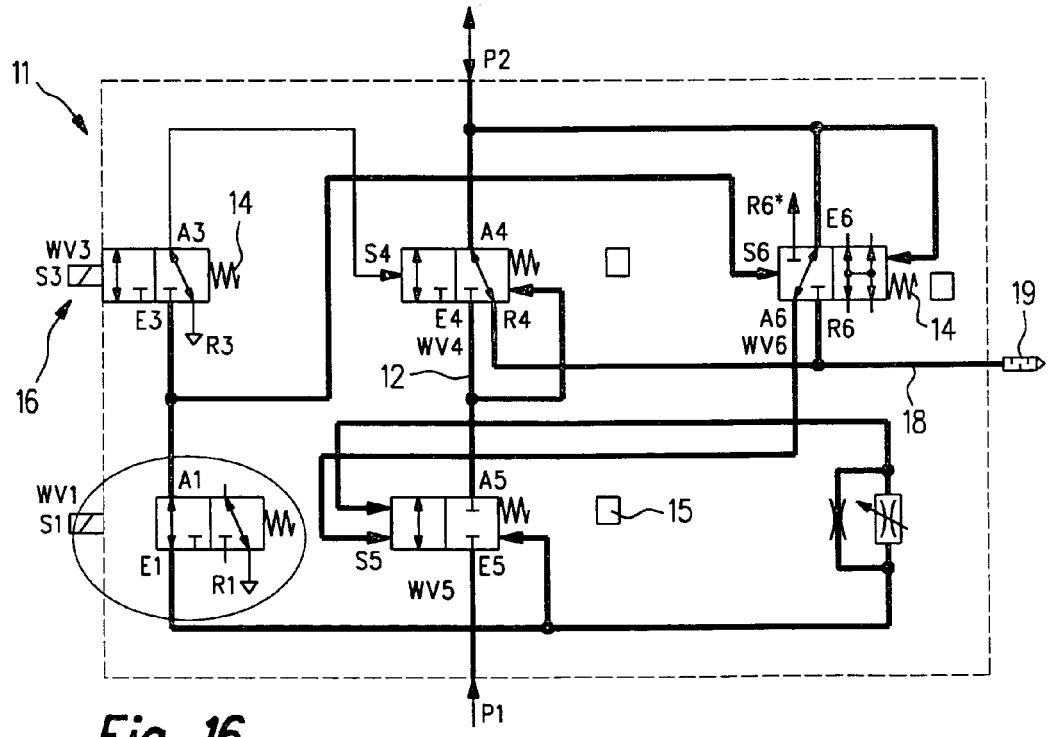
FIG. 16 shows the valve circuit of FIG. 11 during the venting operation and with a faulty function of the first directional valve.

FIG. 16 shows a venting switching setting involving a fault in the first directional valve WV1 and it can not be switched back into its normally closed setting. Accordingly the passage E3 through A3 remains open and compressed air is still present at the control side S6 of the sixth directional valve WV6 so that same dwells in its functional setting. The venting exit R6 of the sixth directional valve WV6 is consequently turned off. Venting is nevertheless possible since the third directional valve WV3 has been properly switched back into normally closed setting and compressed air at the control side S4 of the fourth directional valve WV4 can escape by way of the venting exit R2 with the consequence that the fourth directional valve WV4 is switched back into its normally closed setting. Compressed air stemming from the secondary outlet P2 can now escape by way of the venting exit R4. Moreover the control side S5 of the fifth directional valve WV5 is vented via the connections A6 through E6 and the venting exit R4 so that the fifth directional valve WV5 switches back into its normally closed setting.

Figure 17:
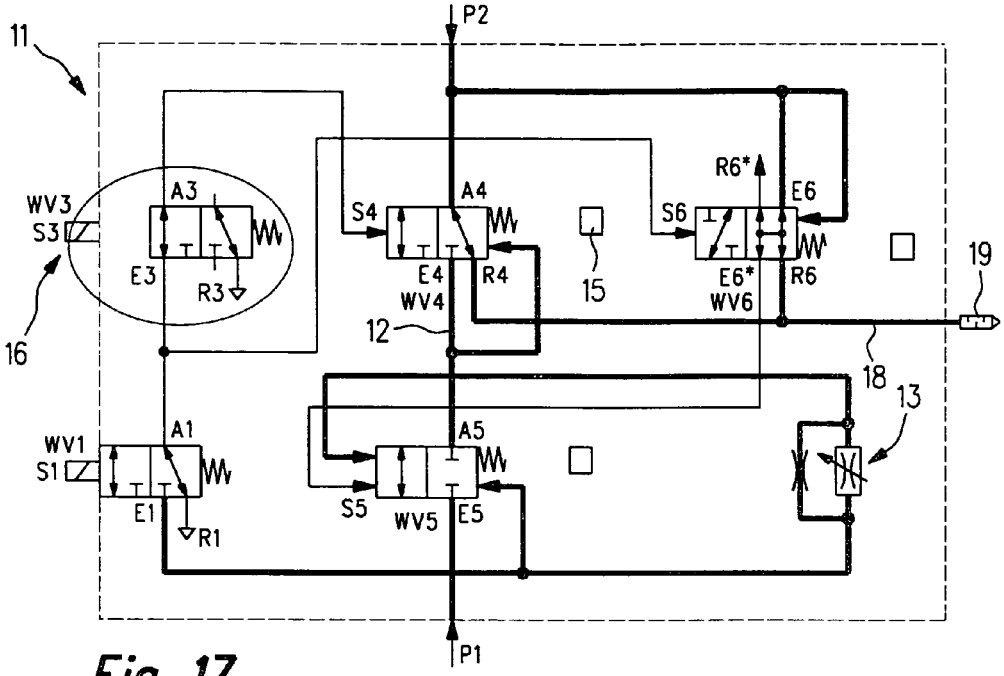
FIG. 17 shows the valve circuit of FIG. 11 during the venting operation and with the a faulty function of the third directional valve.

FIG. 17 shows a venting switching setting involving a fault in the function of the third directional valve WV3, i.e. it is not returned to its normally closed setting. The particular feature here is that the control side S4 of the fourth directional valve WV4 is nevertheless vented, that is to say by way of the first directional valve WV1 (which has properly switched back into its normally closed setting) via the connections A3 through E3 and A1 through R1. Accordingly the fourth and the sixth directional valves WV4 and, respectively, WV6 are switched back into their normally closed settings so that compressed air stemming from the secondary outlet P2 may escape both by way of the venting exit R4 and also via the venting exit R6.

Figure 18:
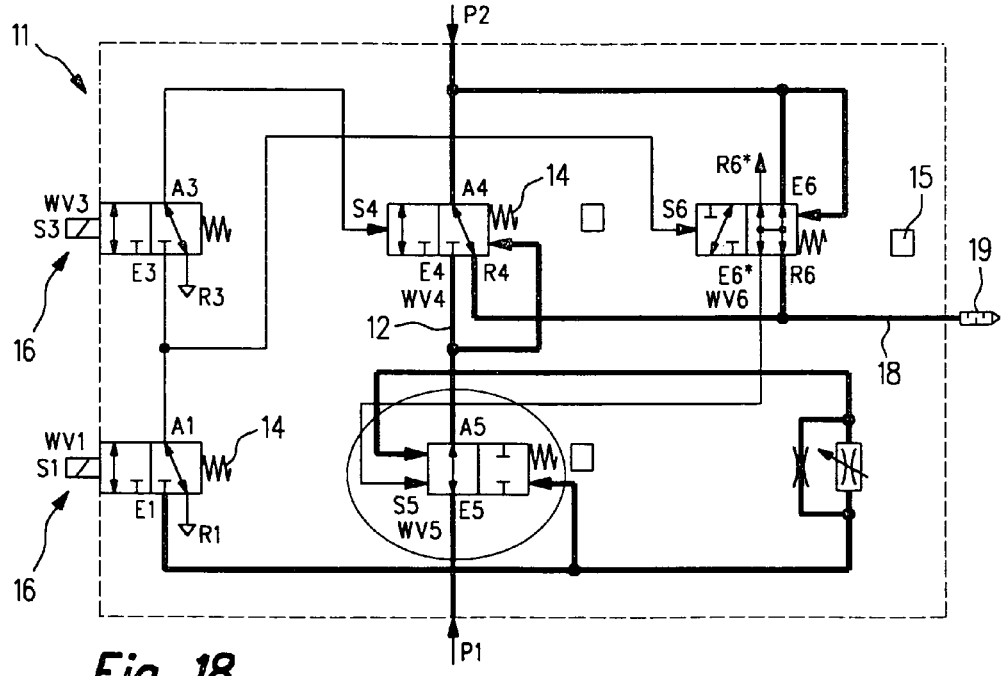
FIG. 18 shows the valve circuit of FIG. 11 during the venting operation and with the a faulty function of the fifth directional valve.

FIG. 18 depicts a venting switching setting involving improper functioning of the fifth directional valve WV5 or, respectively, the principal valve i.e. it does not return to its normally closed setting. For this reason the principal flow path 12 remains open via E5 through A5 so that compressed air arriving from the primary inlet P1 can flow in to take its place. Venting is nevertheless possible since the two directional valves WV1 and WV3 have switched back into their normally closed settings so that the control side S4 of the fourth directional valve WV4 can be vented like the control side S6 of the sixth directional valve WV6 so that the fourth and the sixth directional valves WV4 and WV6 have switched back into their normally closed settings. Accordingly venting of the compressed air stemming from the secondary outlet P2 is again possible by way of the venting exits R4 and R6.

Figure 19:
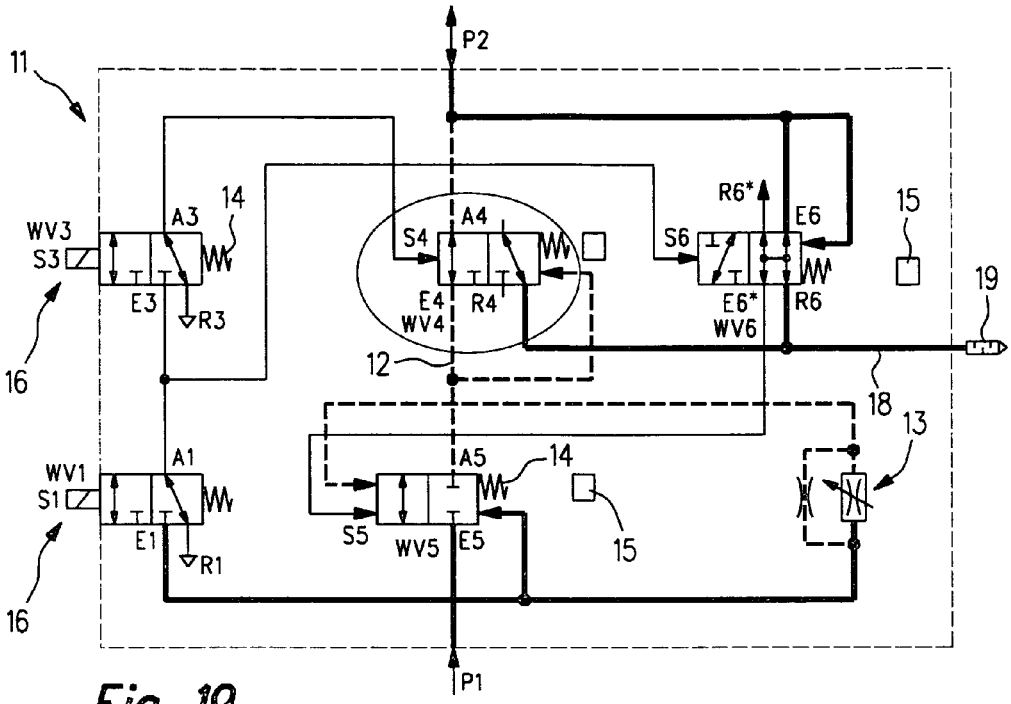
FIG. 19 shows the valve circuit of FIG. 11 during the venting operation and with a faulty function of the fourth directional valve.

FIG. 19 shows a venting switching setting involving faulty functioning of the fourth directional valve WV4, it not having switched back into its normally closed setting. The venting exit R4 is therefore turned off. Venting is however still possible, since the first and the third directional valves WV1 and WV3 have properly switched back into their normally closed settings so that more particularly the control side S6 of the sixth directional valve is vented and it is switched back into its normally closed setting and the compressed air present at the control side S5 of the fifth directional valve WV5 is vented by way of the connections E6* and R6* and the fifth directional valve is also switched back into its normally closed setting. Compressed air from the secondary outlet P2 can now escape by way of the venting exit R6.

Figure 20:
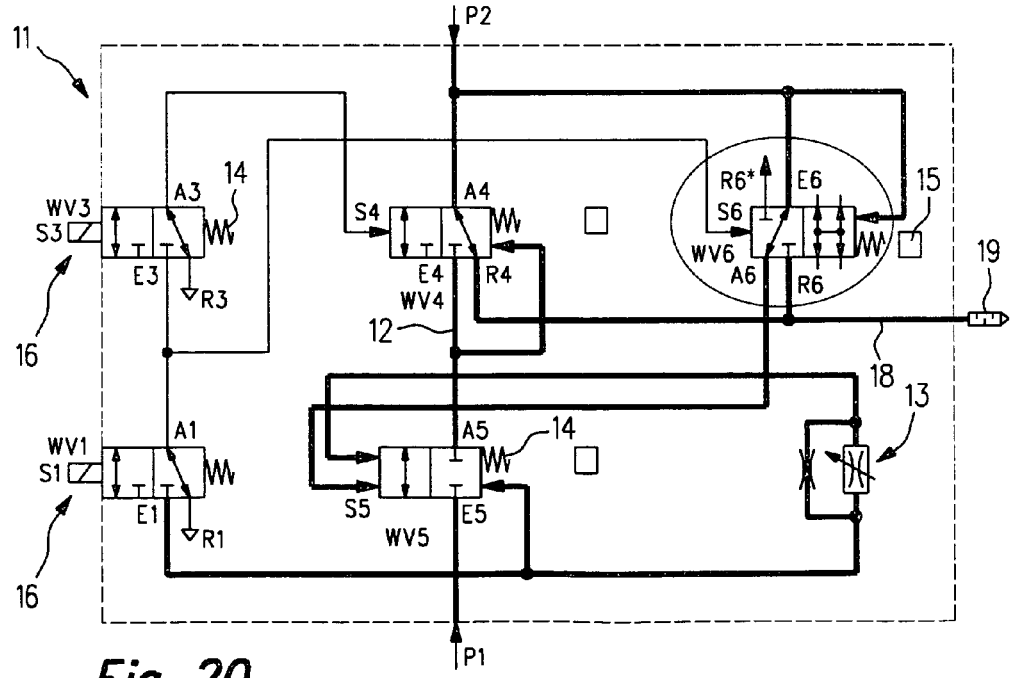
FIG. 20 shows the valve circuit according to FIG. 11 during the venting operation and with the sixth directional valve in a faulty condition.

FIG. 20 shows a venting switching setting involving faulty functioning of the sixth directional valve WV6, that is to say it has not returned to its normal setting. Consequently the venting exit R6 is turned off. The first and the third directional valves WV1 and WV3 have however been properly switched back into their normally closed settings so that the control side S4 of the fourth directional valve WV4 is vented and compressed air stemming from the secondary outlet P2 can escape by way of the venting exit R4. Additionally the control side R5 is vented by way of the connections A6 through E6 and the venting exit R4 and the fifth directional valve is switched back to its normally closed setting.

What is claimed is:

1. A soft start device for compressed air systems, comprising;

a primary inlet by way of which compressed air may be supplied at a primary pressure to a valve circuit having valves including a principal valve, said primary inlet being able to be coupled with a secondary outlet, able to be coupled with at least one load, by way of the valve circuit, at which the compressed air may be removed at a secondary pressure, the secondary pressure being less than or equal to the primary pressure, said principal valve of the normally closed type 2/2 being placed between the primary inlet and the secondary outlet, said principal valve being able to be shunted by a bypass, said bypass including a choke device, said principal valve and said choke device together with further of the valves of the valve circuit being so connected together that with said principal valve initially turned off during a starting operation with said principal valve initially closed compressed air is applied to the secondary outlet at a gradually increasing secondary pressure less than the primary pressure, until as from a predetermined relationship between the secondary and primary pressures a switching operation of said principal valve into its open position takes place so that compressed air passes at the primary pressure to the secondary outlet, and the valve circuit is adapted to be set in such a standard venting switching setting that the compressed air in the valve circuit is vented through a combination of venting exits of the valves of the valve circuit, wherein the valves of the valve circuit are operatively coupled with each other in a combination of series and shunt connections so that, in addition to the standard venting switching setting, a plurality of further venting switching settings is possible, the further venting switching settings venting the compressed air in the valve circuit through a different combination of venting exits of the valves than the standard switching setting, the further venting switching settings resulting when, in the actuating operation normally causing the standard venting switching setting, a fault in function existing in any one of the valves prevents the compressed air from being vented from the valve circuit using the standard venting switching setting.

2. The soft start device as set forth in claim 1 having the following structure of the valve circuit:

an inlet of a second directional valve of the normally closed (nc) type 3/2 is connected with the primary inlet and the outlet of the second directional valve is connected in a parallel circuit with the inlet of the principal valve designed as a fifth directional valve of the type 2/2-nc, with the inlet of a third directional valve of the type 3/2-nc, with the inlet of the choke device and with the outlet of a check valve adapted to close in the secondary outlet direction, the second directional valve being adapted to be vented by way of a venting exit and is coupled on the control side with the primary inlet, an inlet of a first directional valve of the type 3/2-nc, serving for control of the second directional valve, is connected with the primary inlet and the outlet is connected with the control side of the second directional valve, the first directional valve being able to be vented by way of a venting exit and to be actively switched by means of switching means arranged on the control side, the outlet of the fifth directional valve is connected with an inlet of a fourth directional valve of the type 3/2-nc and in parallel with the outlet of the choke device, the fifth directional valve being coupled with the outlet of the fourth directional valve, an outlet of a third directional valve serving for control of the fourth directional valve is coupled with the control side of the fourth directional valve, the third directional valve being able to be vented by way of a venting exit and being able to be actively switched by way of switching means arranged on the control side, an outlet of the fourth directional valve is connected in parallel for coupling with the control side of the fifth directional valve, with the secondary outlet and with the inlet of the check valve, the fourth directional valve being able to be vented by way of a venting exit.

3. The soft start device as set forth in claim 2, wherein the first and the second directional valves together constitute a switching-on stage placed upstream from the fifth directional valve and the third, fourth and fifth directional valves together with the choke device and the check valve form a soft start stage rendering the soft start possible.

4. The soft start device as set forth in claim 3, wherein the switching-on stage comprises a switching valve unit and the soft start stage comprises a separate soft start valve unit able to be separated from the switching on valve unit.

5. The soft start device as set forth in claim 1, wherein the choke device possesses an adjustable choke valve.

6. The soft start device as set forth in claim 1, having the following structure of the valve circuit:

the inlet of the principal valve designed as a fifth directional valve of the type 2/2-nc is connected with the primary input and the outlet is connected with an inlet of a fourth directional valve of the type 3/2-nc and in parallelism to this with the outlet of the choke device, the fifth directional valve being coupled on the control side with the outlet of the choke device and additionally with an outlet of a sixth directional valve of the type 4/2-nc, an inlet of a first directional valve of the type 3/2-nc is connected with the primary inlet and the outlet is connected with the inlet of a third directional valve of the type 3/2-nc and in parallelism thereto with a control side of a sixth directional valve, the first directional valve being able to be vented by way of a venting exit and actively switched by switching means arranged on the control side, an outlet of a third directional valve is coupled with a control side of a fourth directional valve of the type 3/2-nc, the third directional valve being able to be vented by way of a venting exit and is able to be actively switched by way of switching means arranged on a control side, an outlet of the fourth directional valve is connected with the secondary outlet and parallel thereto is connected with an inlet of the sixth directional valve, the fourth directional valve being able to be vented by way of a venting exit, and the sixth directional valve is able to be switched between a normal setting and a functional setting and in the normal setting a first inlet is connected with the secondary outlet and parallel thereto with the outlet of the fourth directional valve, while the first outlet belonging thereto is open to the atmosphere and a second inlet is coupled with a control side of the fifth directional valve, while a second outlet belonging thereto is open to the atmosphere and in the functional setting the inlet is connected with the outlet of the fourth directional valve and parallel thereto is connected with a secondary outlet and the outlet belonging thereto is coupled with a control side of the fifth directional valve.

7. The soft start device as set forth in claim 6, wherein the venting exits of the fourth and sixth directional valves are collected together in a common central venting exit open to the atmosphere.

8. The soft start device as set forth in claim 7, wherein the central venting exit is provided with a muffler for silencing the emerging compressed air.

9. The soft start device as set forth in claim 6, wherein the fifth directional valve is held in its normally closed setting by a setting spring and additionally by the action of compressed air via a coupling with the primary inlet and the fourth directional valve is held by a setting spring and additionally by compressed air pressure via a coupling with the outlet of the fifth directional valve and parallel to this with the outlet of the choke device and the sixth directional valve is held in its normally closed setting by a setting spring and additionally by the action of compressed air via a coupling with the secondary outlet and parallel to this with the outlet of the fourth directional valve.

10. The soft start device as set forth in claim 6, wherein the choke device comprises an adjustable choke valve and additionally a set choke in the form of a choke-bypass shunting the adjustable choke.

11. The soft start device as set forth in claim 1, wherein the relationship between the secondary and primary pressure, as from which a switching operation of the principal valve into its open setting occurs is in a range of about 0 to about 1.

12. The soft start device as set forth in claim 1, comprising a sensor means with a plurality of sensors for detecting the current switched states of the directional valves and more particularly of the non-active switchable directional valves.

13. The soft start device as set forth in claim 1, wherein the relationship between the secondary and primary pressure, as from which a switching operation of the principal valve into its open setting occurs is in a range of 0.4 to 0.6.

* * * * *